US006913864B2

(12) United States Patent
Shimizu et al.

(10) Patent No.: US 6,913,864 B2
(45) Date of Patent: Jul. 5, 2005

(54) BLACK TONER

(75) Inventors: Jun Shimizu, Wakayama (JP); Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 49 days.

(21) Appl. No.: 10/186,991

(22) Filed: Jul. 2, 2002

(65) Prior Publication Data

US 2003/0017405 A1 Jan. 23, 2003

(30) Foreign Application Priority Data

Jul. 4, 2001 (JP) ..... 2001-204012

(51) Int. Cl.[7] ..... G03G 9/09
(52) U.S. Cl. ..... 430/108.6; 430/108.1; 430/108.21; 430/109.4
(58) Field of Search ..... 430/108.1, 108.21, 430/108.24, 108.23, 108.6, 108.4

(56) References Cited

U.S. PATENT DOCUMENTS

| | | | | | |
|---|---|---|---|---|---|
| 5,262,264 | A | * | 11/1993 | Shimizu et al. | 430/107.1 |
| 5,663,027 | A | * | 9/1997 | Kohri et al. | 430/106.2 |
| 6,077,638 | A | * | 6/2000 | Tanikawa et al. | 430/106.2 |
| 6,130,017 | A | | 10/2000 | Hayashi et al. | |
| 2002/0076635 | A1 | | 6/2002 | Yoshino et al. | |
| 2002/0177059 | A1 | * | 11/2002 | Sata et al. | 430/108.6 |
| 2003/0054276 | A1 | * | 3/2003 | Moriyama et al. | 430/106.2 |
| 2003/0059699 | A1 | * | 3/2003 | Tachi et al. | 430/108.6 |
| 2003/0129516 | A1 | * | 7/2003 | Nakamura et al. | 430/108.21 |

FOREIGN PATENT DOCUMENTS

| | | | | |
|---|---|---|---|---|
| JP | 01254968 | A * | 10/1989 | G03G/9/08 |
| JP | 05027481 | A * | 2/1993 | G03G/9/09 |
| JP | 9-25126 | | 1/1997 | |
| JP | 2000-10344 | | 1/2000 | |
| JP | 2002-139865 | | 5/2002 | |

OTHER PUBLICATIONS

Chemical Abstracts Registry #147–14–8 (2003).*
Chemical Abstracts Registry #16143–80–9 (2003).*
Derwent Acc. #1994–308982 (1999).*
Diamond, Arthur S. (editor) Handbook of Imaging Materials. New York: Marcel–Dekker, Inc. (1991) pp. 168–169.*

* cited by examiner

*Primary Examiner*—Christopher RoDee
(74) *Attorney, Agent, or Firm*—Oblon, Spivak, McClelland, Maier & Neustadt, P.C.

(57) ABSTRACT

A black toner comprising a resin binder; and a black colorant comprising a composite oxide of two or more metals and at least one of a blue dye or pigment and a green dye or pigment. The black toner can be suitably used for the development of a latent image formed in electrophotography, electrostatic recording method, electrostatic printing method or the like.

20 Claims, No Drawings

BLACK TONER

BACKGROUND OF THE INVENTION

1. Field of the Invention

The present invention relates to a black toner used for the development of a latent image formed in electrophotography, electrostatic recording method, electrostatic printing method or the like.

2. Discussion of the Related Art

Conventionally, carbon blacks have been used as a black colorant for a toner but, from the viewpoint of safety hygiene and especially triboelectric control of toners, various composite oxides have been proposed as black colorants used in place of carbon black (Japanese Patent Laid-Open No. 2000-10344 (U.S. Pat. No. 6,130,017), Japanese Patent Laid-Open No. Hei 9-25126 and the like). However, the above-mentioned composite oxides give high chroma and dull black color, as compared to carbon black.

An object of the present invention is to provide a black toner which comprises a composite oxide of two or more metals as a black colorant and gives clear black color with low chroma.

These and other objects of the present invention will be apparent from the following description.

SUMMARY OF THE INVENTION

The present invention relates to a black toner comprising:

a resin binder; and a colorant comprising a composite oxide of two or more metals and at least one of a blue dye or pigment and a green dye or pigment.

DETAILED DESCRIPTION OF THE INVENTION

One of the greatest features of the toner of the present invention resides in that a composite oxide of two or more metals is used together with at least one of a blue dye or pigment and a green dye or pigment. The composite oxide gives dull black color, but clear black color is obtained by using at least one of a blue dye or pigment and a green dye or pigment in combination with the composite oxide.

The composite oxide has an average particle size of preferably from 5 nm to 1 $\mu$m, more preferably from 5 to 500 nm, especially preferably from 5 to 300 nm, from the viewpoints of the oil absorption and the covering strength.

In the present invention, the composite oxide is constituted by at least 2 metals from the viewpoint of the degree of blackness of the toner. Especially, it is preferable that at least one, preferably at least two, of the metals of the composite oxide belongs to Group 2 or 13 of the Third Period of the Periodic Table, or to Groups 3 to 11 of the Fourth Period of the Periodic Table. Magnesium (Mg) and aluminum (Al) belong to Group 2 or 13 of the Third Period of the Periodic Table, and scandium (Sc), titanium (Ti), vanadium (V), chromium (Cr), manganese (Mn), iron (Fe), cobalt (Co), nickel (Ni) and copper (Cu) belong to Groups 3 to 11 of the Fourth Period of the Periodic Table. Among them, Mg, Al, Ti, Mn, Fe and Cu are preferable, and Mg, Al, Ti, Fe and Cu are especially preferable. The compositional ratio of the metals in the composite oxide is not particularly limited.

The content of the composite oxide is preferably from 4 to 30% by weight, more preferably from 4 to 20% by weight, especially preferably from 7 to 15% by weight, of the toner, from the viewpoints of the degree of blackness and the specific gravity of the toner.

The process for preparing a composite oxide includes a process comprising depositing another oxide on a surface of the main oxide used as a core particle (Japanese Patent Laid-Open No. 2000-10344 (U.S. Pat. No. 6,130,017)), a process of forming a composite oxide comprising sintering several oxides (Japanese Patent Laid-Open No. Hei 9-25126), and the like, without being particularly limited thereto.

The preferable commercially available composite oxide in the present invention includes "Dye Pyroxide Black No. 1," "Dye Pyroxide Black No. 2" (hereinabove commercially available from DAINICHISEIKA COLOR & CHEMICALS MFG. CO., LTD.), "HSB-603Rx," "HSB-605" (hereinabove commercially available from Toda Kogyo Corp.), "ETB-100" (commercially available from Titan Kogyo K.K.), MC Series (commercially available from MITSUI MINING & SMELTING CO., LTD.), and the like.

The blue dye or pigment includes, for instance, dyes or pigments classified as blue in the color index. As the dyes or pigments classified as blue in the color index, pigments classified as C.I. Pigment Blue (hereinafter abbreviated as "P.B.") are preferable. Among them, phthalocyanine pigments such as P.B. 15, P.B. 15:1, P.B. 15:2, P.B. 15:3, P.B. 15:4, P.B. 15:5 and P.B. 15–16 re more preferable.

The green dye or pigment includes, for instance, dyes or pigments classified as green in the color index. As the dyes or pigments classified as green in the color index, pigments classified as C.I. Pigment Green (hereinafter abbreviated as "P.G.") are preferable. Among them, phthalocyanine dyes such as P.G.7 and P.G. 36 are more preferable.

Usable blue dyes or pigments and green dyes or pigments other than the above-mentioned ones include blue oil-soluble dyes such as C.I. Solvent Blue 25, C.I. Solvent Blue 70 and C.I. Solvent Blue 40; blue or green organic pigments such as phthalocyanine pigments, anthraquinone pigments and chelate-azo pigments; blue inorganic pigments such as cobalt blue, cerulean blue, asbolite, ultramarine and Prussian blue; green inorganic pigments such as chrome green, zinc green, chrome oxide, viridian and emerald green, and the like.

In the present invention, the blue dye or pigment and the green dye or pigment may be used alone or in admixture thereof. However, it is preferable that either one of the blue dye or pigment and the green dye or pigment is contained alone, and it is more preferable that the blue dye or pigment is contained alone. In addition, among the dyes or pigments, pigments are preferable from the viewpoints of light fastness and covering strength.

The total content of the blue dye or pigment and the green dye or pigment is preferably from 0.1 to 4% by weight, more preferably from 0.5 to 2% by weight, of the toner.

The total content of the blue dye or pigment and the green dye or pigment is, preferably smaller than the content of the composite oxide, more preferably one-third or less of the content of the composite oxide, especially preferably one-fifth or less of the content of the composite oxide, taking the effect of the toner on the degree of blackness and the chargeability into consideration.

The resin binder in the present invention includes polyesters, vinyl resins such as styrene-acrylic resins, epoxy resins, polycarbonates, polyurethanes, hybrid resins in which two or more resin components are partially chemically bonded, and the like, without being particularly limited thereto. Among them, from the viewpoints of the dispersibility of the colorant and the transferability, the polyester, and the hybrid resin comprising a polyester component and a vinyl resin component are preferable, and the polyester is more preferable. The content of the polyester or the hybrid resin is preferably from 50 to 100% by weight, more preferably from 80 to 100% by weight, especially preferably 100% by weight, of the resin binder.

The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

The raw material monomer for the polyester includes dihydric or higher polyhydric alcohols and dicarboxylic or higher polycarboxylic acid compounds.

The dihydric alcohol includes alkylene oxide adducts of bisphenol A such as polyoxypropylene(2.2)-2,2-bis(4-hydroxyphenyl)propane and polyoxyethylene(2.2)-2,2-bis(4-hydroxyphenyl)propane, ethylene glycol, 1,2-propylene glycol, 1,4-butanediol, neopentyl glycol, polyethylene glycol, polypropylene glycol, bisphenol A, hydrogenated bisphenol A, and the like.

The trihydric or higher polyhydric alcohol includes, for instance, sorbitol, pentaerythritol, glycerol, trimethylolpropane, and the like.

In addition, the dicarboxylic acid compound includes, for instance, dicarboxylic acids such as maleic acid, fumaric acid, phthalic acid, isophthalic acid, terephthalic acid, adipic acid, and succinic acid; a substituted succinic acid of which substituent is an alkyl group having 1 to 20 carbon atoms or an alkenyl group having 2 to 20 carbon atoms, such as tetrapropenylsuccinic acid, n-dodecenylsuccinic acid, isododecenylsuccinic acid, n-dodecylsuccinic acid, isooctenylsuccinic acid and isooctylsuccinic acid; acid anhydrides thereof or lower alkyl(1 to 3 carbon atoms) esters thereof; and the like.

The tricarboxylic or higher polycarboxylic acid compound includes, for instance, 1,2,4-benzenetricarboxylic acid (trimellitic acid), 2,5,7-naphthalenetricarboxylic acid, pyromellitic acid, acid anhydrides thereof, lower alkyl(1 to 3 carbon atoms) esters thereof, and the like.

The polyester can be prepared by, for instance, polycondensation of an alcoholic component, a carboxylic acid compound and the like at a temperature of 180° to 250° C. in an inert gas atmosphere in the presence of an esterification catalyst as desired.

It is preferable that the polyester has an acid value of from 0.5 to 60 mg KOH/g, from the viewpoint of the dispersibility of the colorant and the transferability, and that the polyester has a hydroxyl value of from 1 to 60 mg KOH/g.

In addition, it is preferable that the polyester has a softening point of preferably 80° to 165° C., and that the polyester has a glass transition point of preferably 50° to 85° C.

The toner of the present invention may appropriately contain, in addition to the resin binder and the colorant, an additive such as a charge control agent, a releasing agent, a fluidity improver, an electric conductivity modifier, an extender, a reinforcing filler such as a fibrous substance, an antioxidant, an anti-aging agent, and a cleanability improver.

The toner of the present invention can be prepared by any of conventionally known methods such as kneading and pulverization method, polymerization method, emulsion and phase inversion method. In a case of a pulverized toner prepared by kneading and pulverization method, for instance, the method comprises homogeneously mixing a resin binder, a colorant, and the like in a mixer such as a Henschel mixer or a ball-mill, thereafter melt-kneading with a closed kneader or a single-screw or twin-screw extruder, cooling, pulverizing and classifying the product. The volume-average particle size of the toner is preferably from 3 to 15 $\mu$m. Further, a fluidity improver such as hydrophobic silica or the like may be added to the surface of the toner as an external additive.

Since the triboelectric charges can be stably maintained in the black toner of the present invention, it is preferable that the black toner of the present invention is used as a nonmagnetic toner. The black toner of the present invention can be used alone as a toner for nonmagnetic monocomponent development, or the black toner can be mixed with a carrier to be used as a two-component developer. Also, it is especially preferable that the black toner is used as a toner for nonmagnetic monocomponent development. In the present invention, the term "nonmagnetic toner" refers to a paramagnetic material, a diamagnetic material, or a ferromagnetic material having a saturation magnetization of 10 $Am^2/kg$ or less, preferably 2.5 $Am^2/kg$ or less.

Further, since the black toner of the present invention has resistance similar to those of colorants such as yellow, cyan and magenta, the black toner can also be suitably used in the formation of full-color fixed images.

EXAMPLES

[Average Particle Size of Composite Oxide]

The number-average particle size is determined by measuring from a micrograph.

[Acid Value and Hydroxyl Value of Resin]

The acid value and the hydroxyl value are determined by a method according to JIS K 0070.

[Glass Transition Point of Resin]

The glass transition point is determined using a differential scanning calorimeter "DSC Model 210" (commercially available from Seiko Instruments, Inc.) with raising the temperature at a rate of 10° C./min.

[Weight-Average Molecular Weight of Resin]

The weight percentage of component soluble to tetrahydrofuran (THF) is determined as the weight-average molecular weight by the GPC Method (column: GMHLX+G3000HXL (commercially available from Tosoh Corporation), standard sample: monodispersed polystyrene, solvent: THF).

Resin Preparation Example 1

The amount 714 g of a propylene oxide adduct of bisphenol A (average number of moles added: 2.2 moles), 663 g of an ethylene oxide adduct of bisphenol A (average number of moles added: 2.2 moles), 518 g of isophthalic acid, 70 g of isooctenylsuccinic acid, 80 g of trimellitic acid and 2 g of dibutyltin oxide were reacted at 210° C. under a nitrogen gas stream with stirring. The polymerization degree was monitored by the softening point determined according to ASTM D36-86, and the reaction was terminated when the softening point reaches 130° C. The resulting resin is referred to as "Resin A." Resin A was a pale yellow solid and had a glass transition point of 65° C. In addition, Resin A had an acid value of 18 mg KOH/g and a hydroxyl value of 35 mg KOH/g.

Example 1

The amount 7000 g of Resin A, 700 g of a composite oxide "MC-6" (commercially available from MITSUI MIN- ING & SMELTING CO., LTD., major metals contained: Fe, Mn, average particle size: 0.02 μm), 70 g of a polypropylene wax "NP-055" (commercially available from MITSUI CHEMICALS, INC.), 70 g of a blue pigment ("Cyanine Blue KRS," commercially available from SANYO COLOR WORKS, LTD., P.B. 15:3) and 70 g of a charge control agent "BONRON S-34" (commercially available from Orient Chemical Co., Ltd.) were supplied into a Henschel Mixer, and mixed at a mixer temperature of 40° C. for 3 minutes with stirring, to give a mixture. The resulting mixture was melt-kneaded at 100° C. with a continuous twin-screw kneader, to give a kneaded product. The kneaded product was then cooled in the air, roughly pulverized and finely pulverized. Thereafter, the resulting product was classified, to give a black powder having a volume-average particle size of 8.5 μm.

The amount 1000 g of the resulting powder and 8 g of a hydrophobic silica "AEROSIL R-972" (commercially available from Nippon Aerosil) were mixed for 3 minutes with stirring with a Henschel mixer, to give a black toner.

Example 2

The same procedures were carried out as in Example 1 except that the amount of "MC-6" used was changed to 1050 g, to give a black toner.

Example 3

The same procedures were carried out as in Example 1 except that 70 g of a green pigment ("Cyanine Green 5310," commercially available from DAINICHISEIKA COLOR & CHEMICALS MFG. CO., LTD., P.G. 7) was used in place of the blue pigment, to give a black toner.

Example 4

The same procedures were carried out as in Example 1 except that the composite oxide was changed to 700 g of "ETB-100" (commercially available from Titan Kogyo K.K., major metals contained: Ti, Fe, average particle size: 0.25 μm), to give a black toner.

Example 5

The same procedures were carried out as in Example 1 except that Resin A was changed to 7000 g of a styrene(St)-butyl acrylate(BA)-methyl methacrylate(MMA) copolymer resin (weight-average molecular weight: 130,000, St/BA/MMA (molar ratio): 82.0/16.5/1.5), to give a black toner.

Example 6

A monomer mixture comprising 60 parts by weight of styrene, 40 parts by weight of butyl acrylate and 8 parts by weight of acrylic acid was added to an aqueous mixed solution comprising 100 parts by weight of water, 1 part by weight of a nonionic emulsifier "EMULGEN 950" (commercially available from Kao Corporation), 1.5 parts by weight of an anionic emulsifier "NEOPELEX F-25" (commercially available from Kao Corporation) and 0.5 parts by weight of potassium persulfate, and the monomers were polymerized with stirring at 70° C. for 8 hours, to give an emulsion of a resin having an acidic polar group, the emulsion having a solid ingredient of 50% by weight. The resin contained in the emulsion had a glass transition point of 55° C., a gelation degree of 5% and a softening point of 148° C.

A mixture of 120 parts by weight of the resulting emulsion of a resin having an acidic polar group, 2 parts by weight of a charge control agent "BONTRON S-34" (commercially available from Orient Chemical Co., Ltd.), 10 parts by weight of a composite oxide "MC-6" (commercially available from MITSUI MINING & SMELTING CO., LTD., major metals contained: Fe, Mn, average particle size: 0.02 μm), 1 part by weight of a polypropylene wax "NP-055" (commercially available from MITSUI CHEMICALS, INC.), 1 part by weight of a blue pigment ("Cyanine Blue KRS," commercially available from SANYO COLOR WORKS, LTD., P.B. 15:3) and 380 parts by weight of water was kept at about 30° C. for 2 hours with dispersing and stirring the mixture with a slusher. Thereafter, with stirring, the mixture was further heated to 70° C. and kept at 70° C. for 3 hours. During this time, it was confirmed by a microscopic observation that a complex of the resin particles and the colorant particles was grown to a size of about 7 μm. After cooling the mixture, the resulting liquid dispersion was filtered with a Buchner funnel, washed with water and vacuum-dried at 50° C. for 10 hours, to give a powder having an average particle size of 9.5 μm.

One-hundred parts by weight of the resulting powder and 0.8 parts by weight of a hydrophobic silica "AEROSIL R-972" (commercially available from Nippon Aerosil, average particle size: 16 nm) were mixed for 3 minutes with stirring with a Henschel mixer, to give a black toner.

Example 7

The same procedures were carried out as in Example 1 except that the composite oxide was changed to 700 g of "MC-10" (commercially available from MITSUI MINING & SMELTING CO., LTD., major metals contained: Mg, Al, Fe, average particle size: 0.1 μm), to give a black toner.

Comparative Example 1

The same procedures were carried out as in Example 1 except that the blue pigment was not used, to give a black toner.

Comparative Example 2

The same procedures were carried out as in Comparative Example 1 except that the amount of "MC-6" used was changed to 1050 g, to give a black toner.

Comparative Example 3

The same procedures were carried out as in Comparative Example 1 except that the composite oxide was changed to 700 g of "ETB-100" (commercially available from Titan Kogyo K.K., major metals contained: Ti, Fe, average particle size: 0.25 μm), to give a black toner.

Reference Example

The same procedures were carried out as in Comparative Example 1 except that 300 g of a carbon black "Mogul L" (commercially available from Cabot Specialty Chemicals Inc.) was used in pace of the composite oxide "MC-6," to give a black toner.

Test Example [Determination of Degree of Blackness of Printed Image]

Each of the black toners obtained in Examples and Comparative Examples was loaded onto a commercially available nonmagnetic, monocomponent printer, and solid images of a square having a side of about 5 cm were printed. During the printing, the amount of toner adhered onto a sheet was adjusted to from 0.6 to 0.7 mg/cm$^2$ by controlling the bias to the developing roller. The color of the printed images (L* value, a* value and b* value) was determined using a colour-difference meter "SE-2000" (commercially available from Nihon Denshoku Kogyo K.K.). The results are shown in Table 1. Here, the lower the chroma $[((a^*)^2+(b^*)^2)^{1/2}]$, preferably the still lower L* value, the clearer the black color.

TABLE 1

| | Color of Printed Image | | |
|---|---|---|---|
| | L* | a* | b* |
| Example Nos. | | | |
| 1 | 20.8 | 1.1 | 1.9 |
| 2 | 17.3 | 0.4 | 1.1 |
| 3 | 21.3 | 1.3 | 3.3 |
| 4 | 15.1 | 0.4 | 1.3 |
| 5 | 18.1 | 1.3 | 2.2 |
| 6 | 22.3 | 2.2 | 3.3 |
| 7 | 19.8 | 1.8 | 2.8 |
| Comparative Example Nos. | | | |
| 1 | 21.9 | 11.5 | 2.5 |
| 2 | 18.9 | 10.2 | 1.9 |
| 3 | 15.7 | 7.7 | 1.1 |
| Reference Example | 14.9 | 0.9 | 0.7 |

It can be seen from the above results that as compared to the toners of Comparative Examples comprising only a composite oxide as a colorant, the toners of Examples comprising a blue or green pigment is used together with a composite oxide give a clear black color of the same level as the toner of Reference Example containing a carbon black, regardless a resin binder and a process of preparing a toner.

According to the present invention, there can be provided a black toner which comprises a composite oxide of two or more metals as a black colorant and gives clear black color.

What is claimed is:

1. A black toner comprising:

a resin binder; and a black colorant comprising a composite oxide of two or more metals and at least one of a blue dye or pigment and a green dye or pigment, wherein the black toner is a nonmagnetic toner.

2. The black toner according to claim 1, wherein the blue dye or pigment is a pigment classified as C.I. Pigment Blue, and the green dye or pigment is a pigment classified as C.I. Pigment Green.

3. The black toner according to claim 1, wherein a total amount of the dye or pigment is smaller than the content of the composite oxide.

4. The black toner according to claim 3, wherein a total amount of the dye or pigment is one-third or less of the content of the composite oxide.

5. The black toner according to claim 1, wherein at least one metal constituting the composite oxide is an element belonging to Groups 3 to 11 of the Fourth Period of the Periodic Table.

6. The black toner of claim 1, wherein said blue dye or pigment and said green dye or pigment is present in an amount of from 0.1–4% by weight.

7. The black toner according to claim 1, wherein the composite oxide is contained in the toner in an amount of 4 to 30% by weight.

8. The black toner according to claim 1, wherein the resin binder comprises a polyester in an amount of 50 to 100% by weight.

9. The black toner according to claim 1, wherein said composite oxide has an average particle size of 5 nm–1 $\mu$m.

10. The black toner of claim 1, wherein said composite oxide has an average particle size of from 5–500 nm.

11. The black toner of claim 1, wherein said composite oxide has an average particle size of from 5–300 nm.

12. The black toner of claim 1, wherein said composite oxide is contained in said toner in an amount of from 4–20% by weight.

13. The black toner of claim 1, wherein said black colorant comprises a composite oxide of two or more metals and a blue dye or pigment alone.

14. A black toner comprising:

a resin binder; and a black colorant comprising a composite oxide of two or more metals and a green dye or pigment alone.

15. The black toner according to claim 14, wherein the green dye or pigment is a pigment classified as C.I. Pigment Green.

16. The black toner according to claim 14, wherein a total amount of the dye or pigment is smaller than the content of the composite oxide.

17. The black toner according to claim 14, wherein at least one metal constituting the composite oxide is an element belonging to Groups 3 to 11 of the Fourth Period of the Periodic Table.

18. The black toner according to claim 14, wherein the composite oxide is contained in the toner in an amount of 4 to 30% by weight.

19. The black toner according to claim 14, wherein the resin binder comprises a polyester in an amount of 50 to 100% by weight.

20. The black toner according to claim 14, wherein said composite oxide has an average particle size of 5 nm–1 $\mu$m.

* * * * *